US005562000A

United States Patent [19]

Shultz, Sr.

[11] Patent Number: 5,562,000

[45] Date of Patent: Oct. 8, 1996

[54] APPARATUS AND METHOD FOR EXPANDING AND SHAPING TUBULAR CONDUITS

[76] Inventor: William E. Shultz, Sr., 239 N. Main St., Lombard, Ill. 60148

[21] Appl. No.: 377,452

[22] Filed: Jan. 24, 1995

[51] Int. Cl.[6] ..... B21D 39/20

[52] U.S. Cl. ..... 72/393

[58] Field of Search ..... 72/393

[56] References Cited

U.S. PATENT DOCUMENTS

| | | | |
|---|---|---|---|
| 199,350 | 1/1878 | Caswell | 72/393 |
| 1,589,541 | 6/1926 | Miller | 72/393 |
| 4,144,735 | 3/1979 | Rothenberger | 72/393 |
| 5,022,254 | 6/1991 | Kramer | 72/393 |

FOREIGN PATENT DOCUMENTS

| | | | |
|---|---|---|---|
| 59-47031 | 3/1984 | Japan | 72/393 |

*Primary Examiner*—Lowell A. Larson

*Attorney, Agent, or Firm*—Marshall, O'Toole, Gerstein, Murray & Borun

[57] ABSTRACT

A tool for reshaping or expanding metal tubular material includes an expandable mandrel having a plurality of duplicate spreader segments held in a cluster by an elastic O-ring about a wedge-shaped cam, each of the segments including an external, curved wall having a curvature corresponding to a curvature of an external curved wall in every other segment such that when all segments are equally spaced a predetermined amount, they form a cylinder having gaps between adjacent spreader segments for contact against an internal surface of the tubular material for reshaping or expanding said tubular material. The wedge-shaped cam includes a plurality of external faces corresponding to a number of internal spreader segment faces sloped to converge toward a front, mandrel-insertion or forward end of the cam and shaped complementary to the shape of the internal spreader segment faces for sliding engagement of the segments over an adjacent external face of the cam. These segments are kept axially aligned during expansion to maintain a substantially uniform mandrel cross-section during tubular stock expansion.

22 Claims, 5 Drawing Sheets

FIG. 5
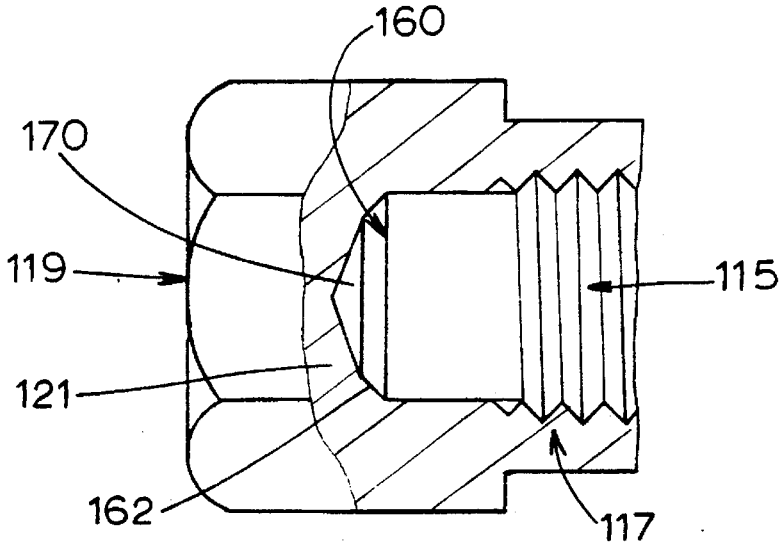
FIG. 7
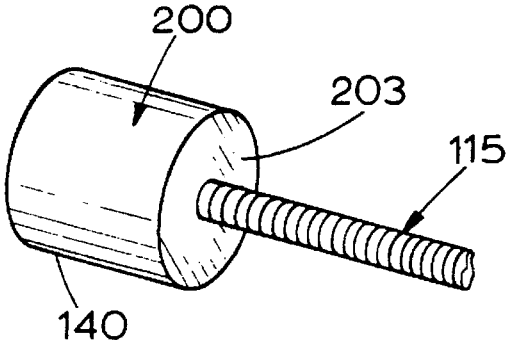
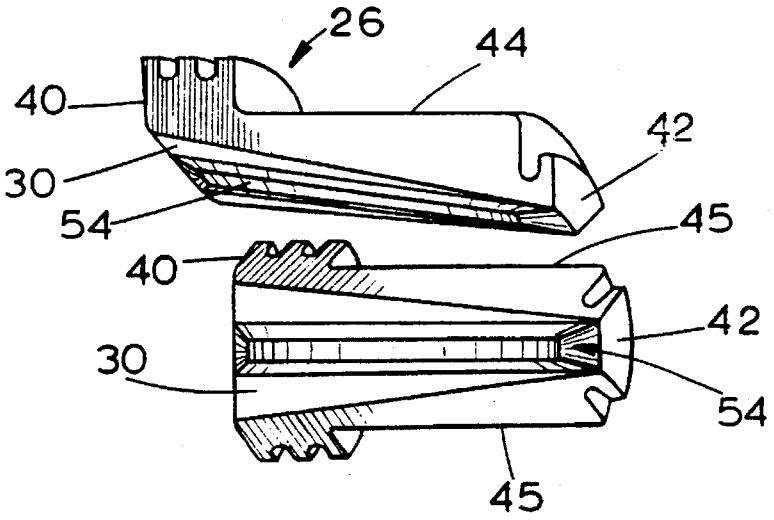
FIG. 6

APPARATUS AND METHOD FOR EXPANDING AND SHAPING TUBULAR CONDUITS

FIELD OF THE INVENTION

The present invention is directed to a method and apparatus for expanding and/or shaping tubular conduits. More particularly, the present invention is directed to a method and apparatus for reshaping or expanding the internal diameter of any tubular conduit utilizing an expandable segmented mandrel and an internal driving wedge. In operation, the internal driving wedge is forced into an internal diameter of the segmented mandrel to expand the spreader segments against an interior diameter of the conduit to be expanded or reshaped to round or otherwise reshape the internal diameter of the conduit.

BACKGROUND OF THE INVENTION AND PRIOR ART

Other tools have been developed for reshaping and restoring damaged or deformed tubular stock, such as the piping of automobile type exhaust systems, as shown in my prior U.S. Pat. No. 3,324,701. One of the disadvantages associated with the tool described in my prior U.S. Pat. No. 3,324,701 is that a threaded handle has to be turned in order to expand a plurality of expandable segments prior to forcing the expandable segments into tubular stock for reshaping the tubular stock. The expandable segments are set initially to a desired diameter by axial movement of a wedge or cam member threaded to a central spindle or shaft. The stock is reshaped by forcing the expanded segments, having tapered leading edges, into the stock and then removing the tool, further expanding the segments, and again forcing the segments into the stock to further reshape the interior of the stock by means of a hammer blow applied to the handle of the tool. The repeated removal and expanding of the device as well as the cumbersome wedge extending from the insertion end of the device makes its use very difficult.

Another disadvantage of U.S. Pat. No. 3,324,701 is that the spreader segments can become misaligned axially with each other during tubular expansion since there is no means to prevent the individual spreader segments from sliding axially on the cam. Lack of axial alignment adversely affects the uniformity of the tubular stock expansion because the cross-sectional geometry of the expanded mandrel becomes less like a circle when the segments are misaligned. The cross-sectional geometry of the mandrel during expansion determines the final cross-sectional geometry of the tubular stock that is expanded. Thus, axially misaligned spreader segments can result in tubular stock being expanded into substantially non-circular and somewhat unpredictable cross-sections.

U.S. Pat. No. 4,753,101 overcomes the disadvantage of the threaded handle that had to be turned; however, it still requires an impact to the wedge for the segments to expand radially. Furthermore, it too has the disadvantage of spreader segments becoming axially misaligned during tubular expansion, causing substantially non-circular expansion of the tubular stock. Also, upon maximum expansion, subsequent impacts or shocks caused a transfer of axial force from the cam member flange directly into spreader segment flanges at an end edge of the mouth of tubular stock. This resulted in axial misshaping of the tubular stock mouth from the axial forces.

Another tool, shown in FIG. 1, accomplishes tubular stock expansion without an axial impact by means of a hammer or the like. In that tool a bolt 1 runs through the hollow center of an internally threaded cam 5. Cam 5 is placed inside tubular stock 32, with the narrow end 7 of cam 5 facing mouth 135 of tubular stock 32. When bolt 1 is rotated, cam 5 is drawn by bolt 1 toward mouth 135 of tubular stock 32. Since cam 5 is shaped as a wedge, with its narrow end 7 facing mouth 135 of the tubular stock 32 to be widened, mandrel 13, comprised of 4 segments 20, receives a radial force when bolt 1 draws cam 5 toward mouth 135 of tubular stock 32. This tool, however, also has the disadvantage of spreader segments 20 becoming axially misaligned with each other, causing the final geometry of the tubular cross-section to be substantially non-circular. This results from lack of any axial alignment means associated with the forward, mandrel-insertion ends 23 of the spreader segments 20.

Another disadvantage is that the amount which tubular stock 32 can be widened is limited by the tubular stock's diameter d1. This is so, because cam 5 must fit inside tubular stock 32 and the dimensions of cam 5 determine the amount of tubular expansion which can occur.

A disadvantage shared by some of the prior art is that a tap on the outside of the tubular stock is required for removal of the device from the tubular stock upon completion of tubular stock expansion. The device of the present invention can be removed smoothly from the tubular stock, without a tap, upon completion of expansion.

SUMMARY OF THE INVENTION

The above disadvantages of the prior art have been overcome in accordance with the apparatus of the present invention. In accordance with the apparatus and method of the present invention, a pyramid-shaped wedge or cam member is forced against internal surfaces of spreader segments by rotation of an internally threaded cylinder over a threaded bolt or the like. The resulting axial movement of the wedge or cam member thereby forces the segments radially outwardly against the internal diameter of the tubular stock, thereby reshaping the tubular stock. The rotation of the internally threaded cylinder will force the wedge or pyramid-shaped cam member of the tool of the present invention into an expandable mandrel, comprised of the spreader segments, to increase the diameter of the expandable mandrel and force the segments against the internal diameter to expand, or remove deformities in, the tubular stock.

In accordance with the present invention, the rotation of the internally threaded cylinder disposed through a central axis of the cam member, forces the cam member into the mandrel thereby forcing the spreader segments radially outwardly. Radial expansion of the mandrel is accomplished substantially without the spreader segments moving axially with respect to the tubular stock. In this manner, the individual segments are not forced into engagement with an end edge of the tubular stock mouth and, therefore, the segments do not further damage or deform the tubular stock. Further, because the axial force applied to the cam member is transmitted essentially only radially against the spreader segments, the mechanic can grasp the tubular stock without mishap while rotating the internally threaded cylinder. Rotating the internally threaded cylinder results in forcing the spreader segments radially outwardly and not axially into contact with the end edge of the tubular stock.

In some embodiments, a cylinder, smaller in diameter than the pipe to be expanded, is attached to a forward, mandrel-insertion end of the bolt. This cylinder is operatively associated with the forward ends of the segments and keeps the segments axially aligned with each other during expansion.

In accordance with a preferred embodiment of the apparatus of the present invention, means for stopping further insertion of the cam member is provided on the apparatus. This means operates independently of the edge of the mouth of the tubular stock to be widened, thereby protecting the mouth from sudden axial force.

Moreover, removal of the apparatus of the present invention upon completion of expansion can be easily accomplished in comparison to prior art devices. In some prior art devices, upon completion of expansion, the expansion device becomes stuck inside the mouth of the tubular stock that is expanded. In order to remove such prior art devices from the tubular stock it became necessary to tap the side of the tubular stock, jarring loose the expansion device from the tubular stock mouth.

The apparatus of the present invention is well suited to use with power tools, including hydraulic wrenches, since excess force from power tools will not deform the edge of the stock mouth beyond the deformation that is intended. Additionally, easy removal of the apparatus of the present invention from the tubular stock upon completion of expansion allows for rapid-action expansion compared to prior devices and facilitates use of power tools. Easy removal is particularly advantageous for wide expansion of tubular stock requiring more than one size mandrel for completion. In such wide expansions, easy removal allows mandrels to be changed quickly from small mandrels to large mandrels.

BRIEF DESCRIPTION OF THE DRAWINGS

FIG. 5 is an enlarged, partially elevated, partially broken-away cross-sectional view of a portion of the apparatus of FIG. 4 showing a gap between the head of the bolt and the nut at maximum expansion of the device of the present invention;

FIG. 6 is a perspective view of two adjacent spreader segments of an expandable mandrel into which a cam member is forced for expansion in accordance with the method and apparatus of the present invention; and FIG. 7 is a perspective view of a cylinder attached to a bolt.

DETAILED DESCRIPTION OF THE PREFERRED EMBODIMENT

Figure 1:
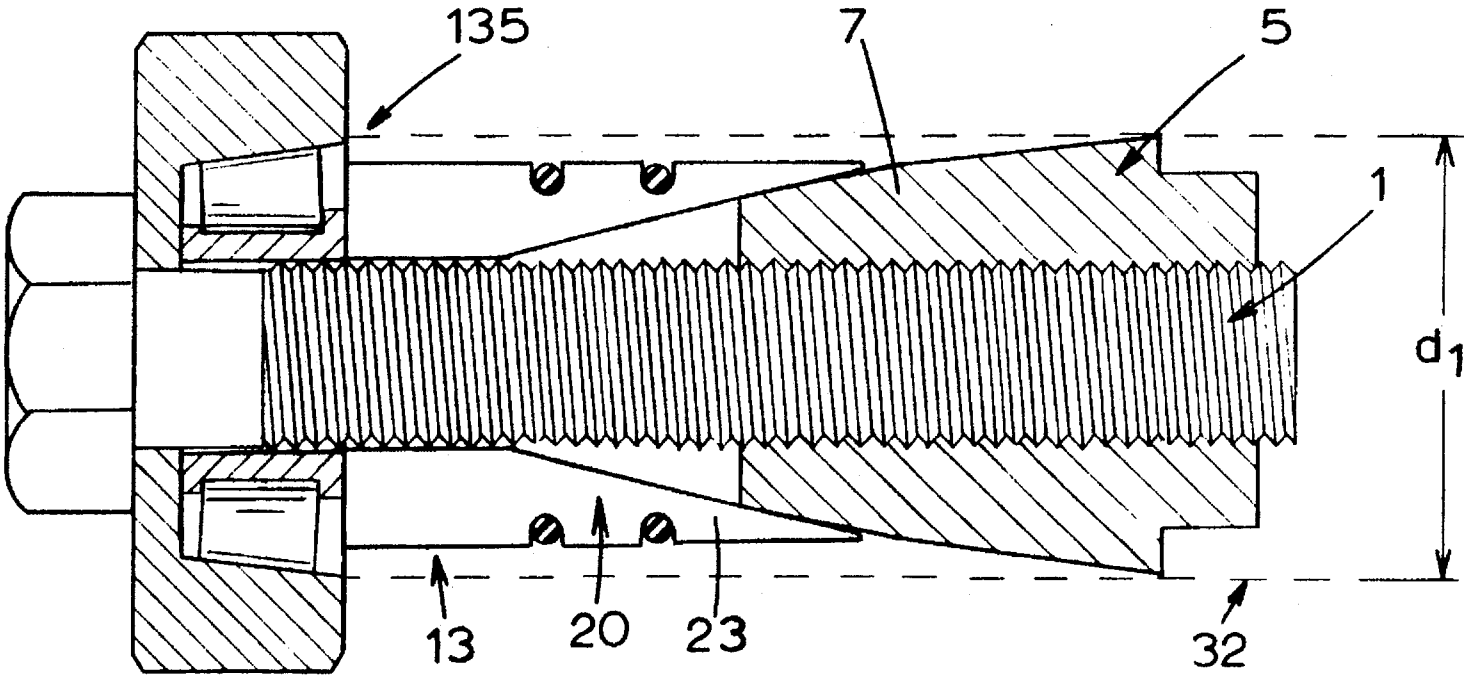
PRIOR ART FIG. 1
FIG. 1 is cross-sectional view of a prior art device taken through a longitudinal central axis of the device.
Figure 2:
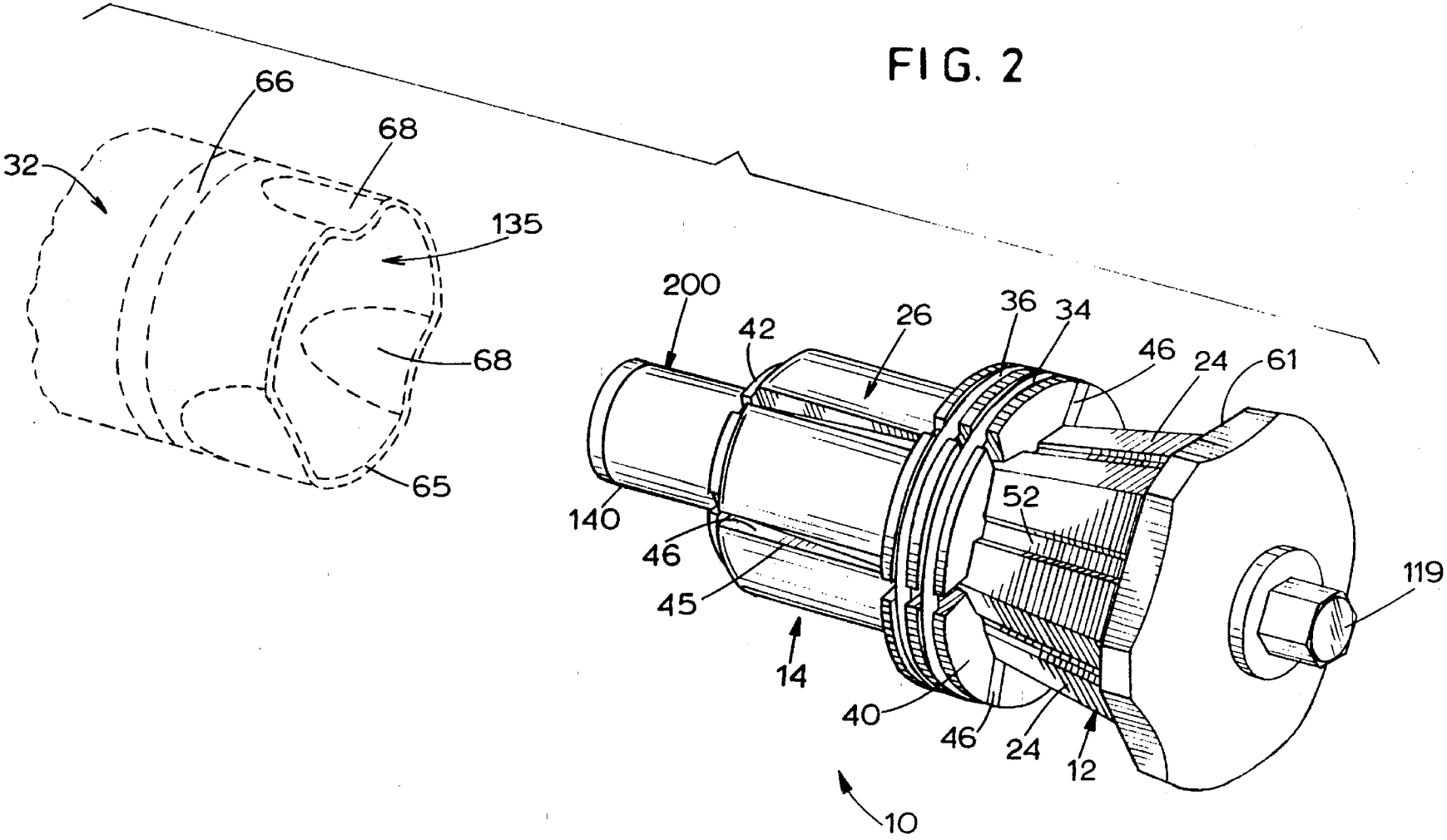
FIG. 2 is a perspective view of the device of the present invention showing a deformed tubular conduit to be expanded in dashed lines.
Figure 3:
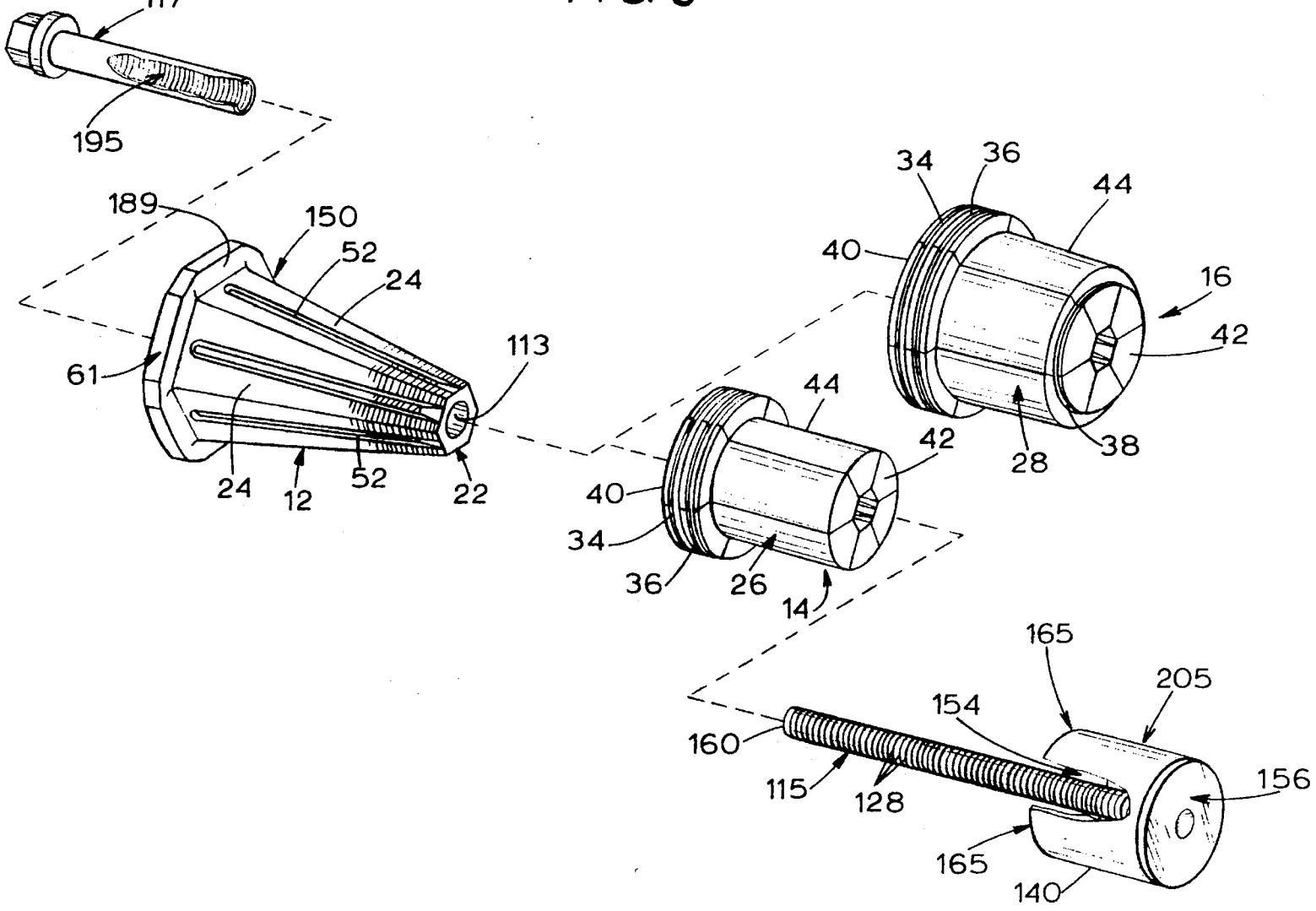
FIG. 3 is an exploded perspective view of the device of the present invention in kit form having a pair of differently sized expandable mandrels.

Turning now to the drawings and initially to FIG. 2, there is shown a new and improved device, generally designated by reference numeral 10, for expanding and/or reshaping a tubular conduit. The device 10 includes a wedge-shaped cam member generally designated by reference numeral 12; and one or more expandable mandrels, generally designated by reference numerals 14 and 16. In a preferred embodiment each segment forming the mandrels 14 or 16 is held in an expandable cluster about the wedge-shaped cam member 12 by a cylinder 200, disposed adjacent the forward ends 42 of segments 26. In the preferred embodiment, the wedge-shaped cam member 12 is in the form of a hexagonal pyramid having six identical external faces 24 extending in uniformly converging relation in a direction toward the forward, smallest diameter end 22 of the wedge-shaped cam member 12, as shown in FIG. 3. Forward end 22 of wedge-shaped cam member 12 is the mandrel-insertion end of cam member 12.

The expandable mandrels 14 and 16 include a number of separate and duplicate spreader segments 26 or 28, the number of segments corresponding to the number of faces 24 on the wedge-shaped cam member 12. Each segment has a forward, mandrel-insertion end 42, a trailing end 40, an internal face 30 and an external, curved wall 44, as shown in FIGS. 3 and 6. It is understood that the number of external faces 24 of the wedge-shaped cam member 12 and the number of duplicate spreader segments 26 or 28 of the expandable mandrels 14 or 16 can be other than six, in accordance with the present invention, so long as the number of external wedge faces 24 corresponds to the number of internal faces 30 on the spreader segments.

The interior faces 30 on each of the duplicate spreader segments 26 and 28 of the expandable mandrels 14 and 16 are sloped complementary to the slope on each of the faces 24 of the wedge-shaped cam member 12. The sloped interior surfaces 30 of segments 26 and 28 slidingly engage the external faces 24 of the wedge-shaped cam member 12 as the wedge-shaped cam member 12 is forced axially into the expandable mandrel. Such action expands the segments 26 or 28 radially outwardly without substantially forcing the expandable mandrel 14 or 16 or its spreader segments 26 and 28 axially into the tubular conduit 32.

The spreader segments 26 and 28 of the mandrels 14 and 16 are maintained in sliding contact with the faces 24 of the wedge-shaped cam member 12 by flexible retainers or elastic O-rings 34, 36 and 38, as shown in FIGS. 2 and 3. Elastic O-rings 34 and 38 are positioned near end surfaces 40 and 42, respectively, of the larger expandable mandrel 16 to maintain the segments 28 in a cluster about the cam member 12. The smaller mandrel 14 does not require O-ring 38 at its insertion or forward end since, due to its shorter length, O-rings 34 and 36 will maintain the segments 26 in position. Each segment 26 or 28 is disposed adjacent to and in contact with one of the faces 24 of the wedge-shaped cam member 12. An intermediate elastic O-ring 36, disposed adjacent to O-ring 34 helps to maintain the segments in axial alignment, after spreading.

Figure 4:
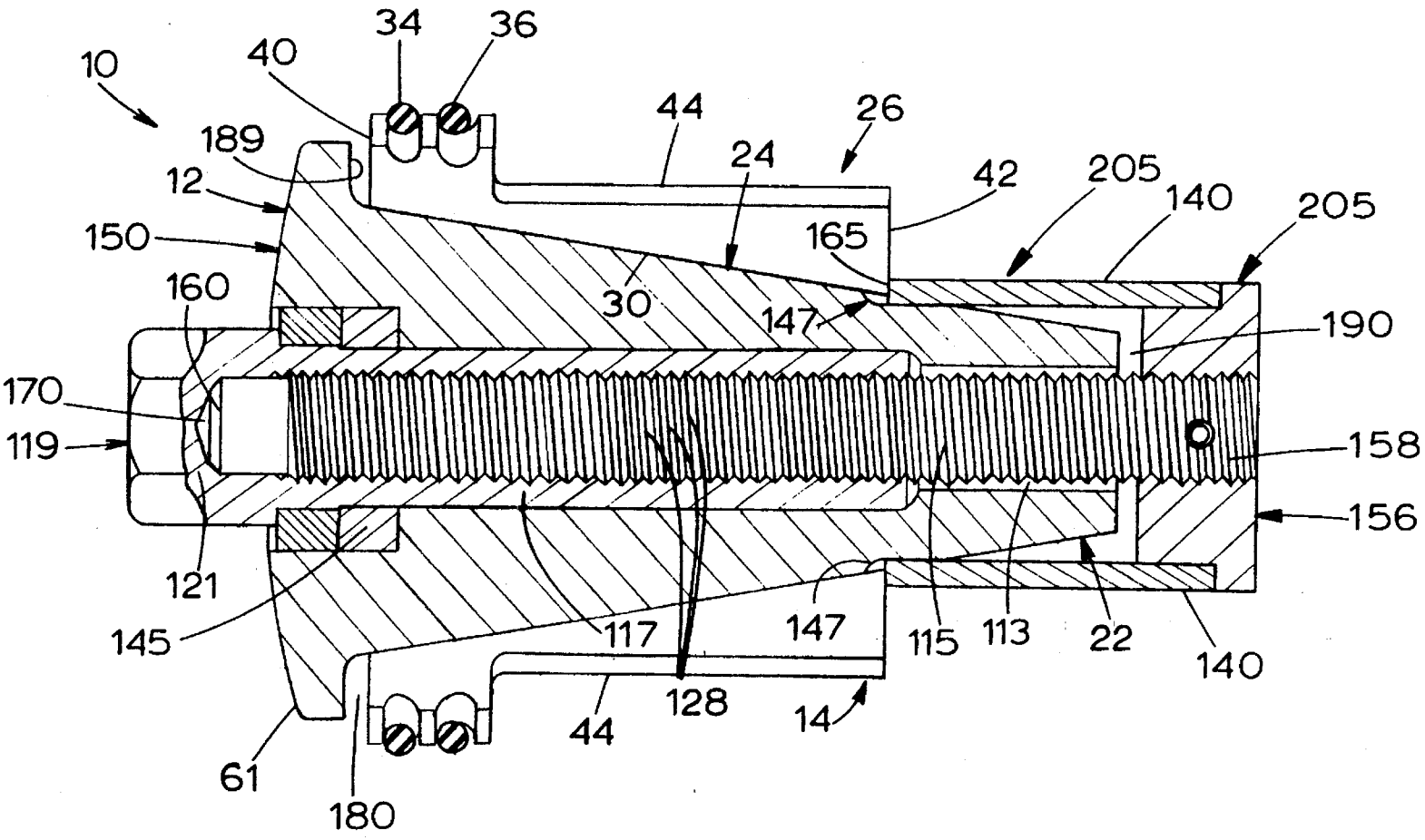
FIG. 4 is a cross-sectional view of the device of the present invention, during maximum expansion, taken through a longitudinal central axis of the device.

As best seen in FIG. 4, when the mandrel 14 or 16 is positioned in a cluster about the wedge-shaped cam member 12, the segments 26 or 28 have their interior faces 30 sloped complementary to the faces 24 of the wedge-shaped cam member 12. The interior faces 30 of each of the spreader segments 26 and 28 slope to converge toward the outer surface 44, from a front or leading surface 42, uniformly in a direction toward both a trailing end 150 of cam member 12 and a rearward surface 40 of each of the spreader segments 26 and 28. This construction maintains essentially cylindrical outer, tubular conduit-contacting outer surfaces 44 at each different position of the spreader segments 26 or 28 along the faces 24 of the wedge-shaped cam member 12. The longitudinal exterior surfaces 44 of the spreader segments 26 are maintained essentially parallel to a central axis of cam member 12 during expansion and contraction of mandrel 14.

In accordance with one important embodiment of the present invention, each of the spreader segments 26 is initially shaped to have an outer surface 44 with a radius of curvature such that when the spreader segments 26 are approximately centrally disposed axially with respect to the external faces 24 of the wedge-shaped cam member 12, the outer surfaces 44 of the spreader segments 26 form a perfect cylinder having a plurality of essentially equally spaced gaps 46 between each of the segments 26. Gaps 46 are shown in FIG. 2.

Since the outer surfaces 44 of each of the spreader segments are formed with a predetermined radius of curvature r, as cam member 12 is inserted into mandrel 14 beyond the point where external faces 24 of cam member 12 are approximately centrally disposed axially with respect to the spreader segments 26, the radius of curvature of the spreader segments will be less than the radius of curvature of the tubular conduit 32. In this manner, the outer surface 44 of the segments will contact the interior tube diameter only at a central portion (about ⅓ to ½ of the central outer curved wall area). Similarly, as the segments are positioned toward the leading edge 22 of the cam member 12, the curvature of the outer walls 44 will be greater than the curvature of the interior diameter of the tubular conduit so that the outer walls 44 will only contact the interior tube diameter at a surface area (⅓ to ½ of the total outer wall area) adjacent the longitudinal edges 45. To achieve the full advantage of the present invention, therefore, the mandrel should form a cylinder when approximately centrally disposed, axially, on the cam member 12, as shown in FIG. 2.

The longitudinal central grooves 52 in each of the external faces 24 of the cam member 12 maintain the segments 26 or 28 circumferentially aligned in a line of travel centrally along each face 24 of the wedge-shaped cam member 12 during radial expansion and contraction of the segments 26 and 28.

These longitudinal, central grooves 52 in each of the faces 24 of the cam member 12 provide a guide path for receiving a centrally disposed raised rib 54 extending outwardly from each of the interior faces 30 of each of the spreader segments 26 or 28 to maintain each spreader segment 26 or 28 centrally disposed, in circumferential alignment along each external wedge face 24 of the cam member 12 during radial expansion and contraction of the spreader segments 26 or 28.

In accordance with a preferred embodiment of the present invention, as shown in the drawings, the cam member 12 and spreader segments 26, 28 are cast from aluminum. Aluminum functions without breakage because the axial force applied to a cam member 12 is essentially completely transferred into a radial force to the outer surfaces 44 of the segments 26, 28.

Cam 12 has a hollow center 113 disposed axially along its entire length. Hollow center 113 receives a threaded bolt 115 and a cam-engaging member 117. In a preferred embodiment an internally threaded cylinder 117 is the cam-engaging member. Internally threaded cylinder 117 is threadedly engaged to threaded bolt 115. In a preferred embodiment, threaded bolt 115 is attached coaxially to cylinder 200 disposed adjacent to narrow end 22 of cam 12. Cylinder 200 is narrower in outer diameter than the inner diameter of tubular stock 32, thereby allowing cylinder 200 to fit inside of tubular stock 32. A solid end 121 of internally threaded cylinder 117 is capped with a nut 119 which can be rotated with respect to threaded bolt 115, causing internally threaded cylinder 117 to apply axial force to threaded bolt 115. A washer 145, preferably made of Hydex® 4301 polycarbonate, is placed between nut 119 and the wide end 150 of cam member 12 to protect metal surfaces during rotation of internally threaded cylinder 117. A bearing or other implement may be used in place of washer 145. Nut 119 remains outside of hollow center 113 of cam member 12.

A force is exerted on cam 12 in the direction of narrow end 22 of cam 12 when bolt 115 is drawn into internally threaded cylinder 117. The axial force exerted upon cam 12 in the direction of narrow end 22 of cam 12 from the rotation of internally threaded cylinder 117 exerts a radial force upon mandrel 14 which in turn expands mandrel 14 and tubular stock 32.

Cylinder 200 keeps spreader segments 26 axially aligned as an axial force on cam member 12 is converted to a radial force applied to spreader segments 26. Cylinder 200 includes a trailing face 203, best shown in FIG. 7, which is defined as the face of cylinder 200 disposed in sliding engagement with the forward ends 42 of spreader segments 26. Axial alignment of spreader segments 26 allows mouth 135 of tubular stock 32 to be uniformly expanded. Axially misaligned spreader segments 26 can result in a substantially non-circular mandrel 14 cross-section during expansion. Since mandrel 14 cross-section determines tubular stock expansion geometry, a mandrel 14 with a substantially non-circular cross-section during expansion produces a substantially non-circular cross-section in mouth 135 of tubular stock 32.

In a more preferred embodiment, cylinder 200 is hollow at 154, an area facing forward ends 42 of spreader segments 26. Cylinder 200 will be referred to as hollow cylinder 205 in those embodiments which require a hollow cylinder. It is understood that many embodiments described with cylinder 200 would also operate with hollow cylinder 205 in place of cylinder 200. Hollow cylinder 205 is solid at 156, the side furthest from cam 12 and it is on the interior 158 of this solid side 156 of hollow cylinder 205 that bolt 115 is attached. Hollow cylinder 205 has the advantage of allowing bolt 115 to be drawn further into internally threaded cylinder 117, thereby increasing the maximum distance which cam 12 can penetrate mandrel 14 and, in turn, increasing the diameter to which mandrel 14 can be expanded.

In a preferred embodiment cylinder 200 also functions to stop bolt 115 from being drawn into internally threaded cylinder 117 so far that mandrel 14 is expanded to an interior diameter greater than the outer diameter of cylinder 200. By keeping the interior diameter of mandrel 14 smaller than the outer diameter of cylinder 200, cylinder 200 prevents spreader segments 26 from sliding on axial surface 140 of cylinder 200. Were spreader segments 26 capable of sliding on axial surface 140 of cylinder 200, said spreader segments would be capable of becoming misaligned, and this misalignment would become more pronounced with increasing degrees of expansion.

Maximum expansion of mandrel 14 is defined as the amount of expansion which mandrel 14 has undergone up to the point at which cam member 12 cannot be inserted any further into mandrel 14. Maximum insertion of cam 12 is defined as the amount of insertion of cam 12 into mandrel 14 which has taken place up to the point at Which cam member 12 cannot be inserted any further into mandrel 14. FIG. 4 shows a device of the present invention at maximum expansion.

There are a multiple means of limiting cam member 12 insertion to a particular distance into mandrel 14. These means of limiting cam member 12 insertion include: (1) obstruction of forward end 22 of cam member 12 by face 203 of cylinder 200; (2) obstruction of flanges 61 of cam member 12 by trailing ends 40 of spreader segments 26; and (3) obstruction of further rotation of internally threaded cylinder 117 by contact between solid end 121 of internally threaded cylinder 117 and an end 160 of threaded bolt 115.

When rotational force is applied to nut 119 after maximum cam insertion has been achieved, that force is absorbed by various parts of the present invention. Cam member 12 insertion limiting means (1) is less preferred because threads 128 of bolt 115, end 22 of cam member 12, and face 203 of cylinder 200 absorb the force, resulting in wear on these parts. Cam insertion limiting means (2) is less preferred because undesired deformation of mouth edge 65 of tubular stock 32 may occur when mouth edge 65 absorbs the force which is transferred axially from flanges 61 to trailing ends 40 of spreader segments 26 to mouth edge 65 of tubular stock 32.

In a most preferred embodiment, shown in FIG. 4, cam insertion limiting means (3) is utilized. In this most preferred embodiment bolt 115 and internally threaded cylinder 117 provide means for stopping further insertion of cam 12 into mandrel 14. This is accomplished by having the length of interior 195 of internally threaded cylinder 117 such that head 160 of bolt 115 reaches the solid end 121 of internally threaded cylinder 117 before cam member 12 contacts hollow cylinder 205.

Solid end 121 of internally threaded cylinder 117 is preferably tapered where bolt 115 contacts solid end 121 of internally threaded cylinder 117 during maximum insertion of cam member 12. End 160 of bolt 115 is preferably both tapered and lacking threads on a region 162 which is the portion of bolt 115 which contacts solid end 121 of internally threaded cylinder 117 during maximum expansion. These features are best seen in FIG. 5, which is an enlarged view of a portion of FIG. 4.

In this most preferred embodiment, upon maximum expansion of mandrel 14, three gaps remain, as shown in FIG. 4. A first gap 170, best shown in FIG. 5, is defined between the end 160 of bolt 115 and solid end 121 of internally threaded cylinder 117. Gap 170 reduces contact between bolt 115 and solid end 121 of internally threaded cylinder 117, allowing easy reverse rotation of internally threaded cylinder 117 for removal of mandrel 14 from tubular stock 32.

Preferably, end 160 of bolt 115 is tapered and lacks threads. In such an embodiment, threads 128 of bolt 115 do not absorb excess force when end 160 of bolt 115 contacts solid end 121 of internally threaded cylinder 117 at maximum expansion. Excess force, in such an embodiment, is absorbed by unthreaded end 160 of bolt 115 and by solid end 121 of internally threaded cylinder 117 at point of contact 162.

A second gap 180 is defined between the trailing ends 40 of spreader segments 26 and the flange 61 on the wide end 150 of cam member 12. Gap 180 prevents cam member 12 from transferring direct axial force to trailing ends 40 of spreader segments 26. An axial force applied from an inner surface 189 of cam member flange 61 on trailing ends 40 of spreader segments 26 would misshape end edge 65 of tubular stock mouth 135. An advantage of this embodiment is that cam member 12 insertion is stopped before flange 61 of cam member 12 contacts the trailing ends 40 of spreader segments 26. In this manner, excess axial force is absorbed by bolt 115 and solid end 121 of internally threaded cylinder 117 rather than end edge 65 of tubular stock mouth 135.

A third gap 190 is defined between cam member forward end 22 and cylinder 205. Gap 190 reduces stress on threads 128 of bolt 115, and reduces wear on both the cylinder 205 and the cam member 12.

This embodiment is well-suited for application with power tools, including hydraulic wrenches, because the excess force applied by a power tool in rotating internally threaded cylinder 117 is absorbed by solid end 121 of internally threaded cylinder 117 rather than edge 65 of tubular stock mouth 135. Also, removal of the device of the present invention from mouth 135 of tubular stock 32, following expansion, can be easily achieved using a power tool by reversing the drive direction of the power tool.

Embodiments in which cylinder 200 stops cam member 12 from further insertion by direct contact with cam member 12, without gap 190, are less preferred. In these less preferred embodiments, bolt threads 128 undergo much stress when force is applied to internally threaded cylinder 117 after further insertion of cam 12 is blocked by cylinder 200. Also, the contact between cam 12 and cylinder 200 at maximum insertion, in these less preferred embodiments, causes wear on those parts.

In embodiments having a hollow cylinder 205, a groove 147 in cam 12 allows cam 12 to be inserted further into hollow cylinder 205 before a trailing edge 165 of hollow cylinder 205 blocks advancement of cam 12. Groove 147, by postponing contact between cam 12 and trailing edge 165 of hollow cylinder 205, reduces the stress experienced by hollow cylinder 205 when mandrel 14 is near maximum expansion. Groove 147 accomplishes this by enabling bolt 115 and internally threaded cylinder 117 to first absorb excess force. Mandrel 14 is near maximum expansion when cam 12 is near maximum insertion into mandrel 14.

For spreader segments 26 to be prevented from sliding over axial surface 140 of cylinder 200, the difference between the outside radius of cylinder 200 and the inner radius of mandrel 14, measured to inside face 30 on forward end 42 of a spreader segment 26 while mandrel 14 is completely unexpanded, should exceed the amount of radial expansion that mandrel 14 can undergo before rotation of internally threaded cylinder 117 is stopped by one of the aforementioned means.

As best shown in FIG. 4, another advantage to the construction of the reshaping or expanding tool of the present invention is that the threaded bolt 115 can remain threadedly connected to cam engaging member 117 so that the threaded connection should not become contaminated with rust, dirt or other contaminants during use. The radial expansion of the mandrels 14 and 16, therefore, will not be impeded by contaminants lodging in the threaded connection.

In the preferred embodiment, relative diameters of the smaller mandrel 14 and the larger mandrel 16 are such that when the smaller mandrel is fully expanded, its diameter is larger than the diameter of the larger mandrel 16, when mandrel 16 is completely unexpanded. In this manner, tubes having diameters across the full range of diameters from the diameter of the completely unexpanded smaller mandrel 14 to the completely expanded larger mandrel 16, can be reshaped or expanded utilizing the two mandrels 14 and 16, employing a single cam member 12.

EXAMPLE

An example containing dimensions for an apparatus in which mandrel 14 is prevented from expanding wider than cylinder 205 is as follows: a mandrel 14 with an inner radius of 9 mm, when measured to the inside face 30 at forward end 42 of spreader segment 26 while mandrel 14 is in a completely unexpanded state; said mandrel with an inner radius of 17 mm, when measured to inside face 30 at forward end 42 of spreader segment 26 when mandrel 14 has undergone maximum expansion. The difference between the outer radius of cylinder 205 (22 mm) and the inner radius of mandrel 14 when mandrel 14 is completely unexpanded (9 mm) is 13 mm in this Example. The change in radius of mandrel 14 during expansion is 8 mm (17–9 mm). 13 mm exceeds 8 mm. Thus, at maximum expansion, forward ends 42 of spreader segments 26 remain in contact with cylinder 205 and said spreader segments 26 are kept in axial alignment since said spreader segments are prevented from sliding upon axial side 140 of cylinder 205.

Additional dimensions of the device of this Example include: the slopes of faces 24 of cam member 12 are 9°; the maximum distance which cam member 12 can be inserted into mandrel 14 axially is 55 mm. In this example, at maximum expansion, cam member 12 insertion limiting means is provided by contact between end 160 of bolt 115 and solid end 121 of internally threaded cylinder 117.

As shown in FIG. 2, the device of the present invention is excellent for removing a circumferential indentation 66 in the tubular conduit 32, such as that caused by a pipe clamp or mitten clamp when two conduits are mechanically secured together, particularly automotive exhaust conduits. Similarly, end deformities 68 commonly encountered in tubular conduits are easily and unexpectedly removed in accordance with the method and apparatus of present invention.

While there has been described what is at present considered to be the preferred embodiment of the invention, it will be understood that various modifications may be made therein which are within the true spirit and scope of the invention. For example, internally threaded cylinder 117 and bolt 115 could be interchanged by replacing cylinder 200 with a nut on the forward, mandrel-insertion end of bolt 115 and by replacing nut 119 with a cylinder attached coaxially to solid end 121 of internally threaded cylinder 117.

What is claimed is:

1. A tool for reshaping or expanding metal tubular stock comprising:

an expandable mandrel including a plurality of spreader segments, each having a forward, mandrel-insertion end, a trailing end, an external, curved wall and a respective internal face, and wherein the spreader segments are adapted to be held in a cluster about a wedge-shaped cam;

a wedge-shaped cam axially movable within the mandrel for spreading the spreader segments, the cam including a plurality of external faces corresponding to internal faces of the spreader segments, and having a hollow center disposed axially therein;

means for flexibly retaining the spreader segments adjacent to the external faces of the cam in a cluster about the cam while allowing sliding engagement of the segments over the external faces of the cam; the external faces of the cam being shaped complementary to the internal faces of the spreader segments whereby an axial force applied to the cam moves the cam axially relative to the mandrel and the spreader segments thereby forcing the spreader segments radially outwardly;

axial force means for applying axial force to the cam, the axial force means including a threaded bolt disposed within the hollow center of the cam, and a cam-engaging member connected to the bolt, such that rotation of the cam-engaging member with respect to the bolt applies axial force on the cam for mandrel expansion;

spreader segment axial alignment means disposed in contact with the forward ends of the spreader segments for maintaining spreader segments axially aligned with each other during mandrel expansion while allowing sliding engagement of the internal faces of the spreader segments over the external faces of the cam, whereby the external, curved walls of the spreader segments are spaced substantially equal radial distances from a central axis of the cam during mandrel expansion; and stop means disposed on the outer surface of the cam for limiting the insertion of the cam into the mandrel.

2. The tool of claim 1, wherein the spreader segment axial alignment means comprises a cylinder having a first face wherein the cylinder is coaxially aligned with the bolt and attached to the bolt and wherein the first face is disposed in sliding engagement with the forward ends of the spreader segments and the cylinder is narrower in diameter than the interior of the tubular stock such that the cylinder can fit inside the tubular stock.

3. The tool of claim 2, wherein the cylinder prevents the cam from axial movement sufficient such that the inner diameter of the mandrel exceeds the outer diameter of the cylinder, whereby the spreader segments are prevented from sliding axially along the cylinder.

4. The tool of claim 2, wherein the axial force means prevents the cam from moving so far that the inner diameter of the mandrel exceeds the outer diameter of the cylinder, whereby the spreader segments are prevented from sliding axially along the cylinder.

5. The tool of claim 1, wherein the external surfaces of the cam form a pyramid shape in which the external cam surfaces converge in a direction toward a forward, mandrel-insertion end.

6. The tool of claim 5, wherein the external surfaces of the pyramid-shaped cam are planar and include circumferential alignment means for maintaining the spreader segments centrally disposed along the cam external surfaces.

7. The tool of claim 6, wherein the circumferential alignment means comprises an elongated groove in an external cam face and a corresponding elongated rib extending from an adjacent planar spreader segment face to maintain the internal, planar spreader segment faces and the external, planar cam faces in alignment and in striking engagement during expansion and contraction of the spreader segments during insertion and removal of the cam.

8. The tool of claim 1, wherein the external faces of the cam are sloped to converge and wherein the internal faces of the spreader segments are sloped to converge in a direction opposite to the converging slope of the external faces on the cam when the spreader segments are held in a cluster about the cam and sloped correspondingly to the slope of the external cam faces so that longitudinal exterior surfaces of the spreader segments are maintained essentially parallel a central axis of the cam during expansion and contraction of the expandable mandrel.

9. The tool of claim 1, wherein the axial force means further includes a power tool operatively connected to the bolt.

10. The tool of claim 9, wherein the power tool is a hydraulic wrench.

11. A tool for reshaping or expanding metal tubular material comprising:

an expandable mandrel including a plurality of duplicate spreader segments held in a cluster by an elastic O-ring about a wedge-shaped cam, the spreader segments including an internal face sloped to converge toward a trailing end of the cam and shaped complementary to an adjacent external face of the wedge-shaped cam and having a raised, elongated, longitudinally disposed rib extending outwardly from the internal face of the spreader segments and adapted to be received within the adjacent cam surface;

each of the spreader segments including a forward, mandrel-insertion end and an external, curved wall having a curvature corresponding to a curvature of an external curved wall in every other spreader segment such that when all spreader segments are equally spaced a predetermined distance, they form a cylinder having gaps between adjacent spreader segments, said cylinder adapted for contact against an internal surface of the tubular material for reshaping or expanding the tubular material;

a wedge-shaped cam including a plurality of external faces corresponding to a number of the internal spreader segment faces sloped to converge toward a forward, mandrel-insertion end of the cam and shaped complementary to the shape of the internal spreader segment faces for sliding engagement of the spreader segments over an adjacent external face of the cam, the external cam faces each including an elongated groove axially aligned with the cam and adapted to receive the raised rib extending from the internal face of the spreader segments;

means for flexibly retaining the spreader segments adjacent to the external faces of the cam in a cluster about the cam for sliding engagement of the spreader segments over the external faces of the cam;

axial force means for applying axial force to the cam;

spreader segment axial alignment means disposed in contact with the forward, mandrel-insertion ends of the spreader segments for maintaining the spreader segments axially aligned with each other during mandrel expansion while allowing sliding engagement of the internal faces of the spreader segments over the external faces of the cam; and stop means disposed within the cam engaging member for contact against an end of the bolt for limiting the insertion of the cam into the mandrel.

12. The tool of claim 11, wherein the spreader segment axial alignment means comprises a cylinder having a first face wherein the cylinder is coaxially aligned with the bolt and attached to the bolt and wherein the first face is disposed in sliding engagement with the forward ends of the spreader segments and the cylinder is narrower in diameter than the interior of the tubular stock such that the cylinder can fit inside the tubular stock.

13. The tool of claim 11, wherein the axial force means includes a threaded bolt disposed within the hollow centers of the cam and the mandrel, and a cam-engaging member threadedly connected to the bolt, such that rotation of the cam-engaging member with respect to the bolt applies axial force on the cam for mandrel expansion.

14. The tool of claim 13, wherein the axial force means further includes a hydraulic wrench operatively connected to the bolt.

15. A tool kit for reshaping or expanding metal tubular stock comprising:

a pair of expandable mandrels each mandrel including a plurality of spreader segments capable of being held in a cluster about a wedge-shaped cam, the spreader segments having forward, mandrel-insertion ends, external, curved walls and internal faces, the spreader segments of one mandrel being of different outer curvature than the spreader segments of the other mandrel and adapted to be held in a cluster about a single cam;

a wedge-shaped cam axially movable within the mandrels for spreading the spreader segments, the cam including a plurality of external faces corresponding to a number of internal faces on the spreader segments;

means for flexibly retaining the spreader segments of one of the mandrels adjacent to the external faces of the cam in a cluster about the cam while allowing sliding engagement of the segments over the external faces of the cam; the external faces of the cam being shaped complementary to the internal faces of the spreader segments whereby an axial force applied to the cam moves the cam axially relative to the mandrel and the spreader segments thereby causing the spreader segments to be moved radially outwardly;

axial force means for applying axial force to the cam, said axial force means including a threaded bolt disposed within the cam and the mandrel, and a cam-engaging member connected to the bolt, such that rotation of the cam-engaging member with respect to the bolt applies axial force on the cam for mandrel expansion;

spreader segment axial alignment means disposed in contact with the forward, mandrel-insertion ends of the spreader segments for maintaining the spreader segments aligned axially with each other during mandrel expansion while allowing sliding engagement of the internal faces of the spreader segments over the external faces of the cam; and stop means disposed on the outer surface of the cam for limiting the insertion of the cam into the mandrel.

16. The tool kit of claim 15, wherein the spreader segment axial alignment means comprises a cylinder having a first face wherein the cylinder is coaxially aligned with the bolt and attached to the bolt and wherein the first face is disposed in sliding engagement with the forward ends of the spreader segments.

17. The tool kit of claim 16, wherein the axial force means prevents the cam from moving so far that the inner diameter of the mandrel exceeds the outer diameter of the cylinder, whereby the spreader segments are prevented from sliding axially along an outer surface of the cylinder.

18. The tool kit of claim 15, wherein the axial force means further includes a power tool coupled to the bolt.

19. The tool kit of claim 18, wherein the power tool is a hydraulic wrench.

20. A tool for reshaping or expanding metal tubular stock comprising:

an expandable mandrel including a plurality of spreader segments held in a cluster about a wedge-shaped cam, the spreader segments each having a forward, mandrel-insertion end, an external, curved wall and a trailing end;

a wedge-shaped cam including a plurality of external faces corresponding to a number of internal faces on the spreader segments and having a hollow center disposed axially therein;

means for flexibly retaining the spreader segments adjacent to the external faces of the cam in a cluster about the cam while allowing sliding engagement of the segments over the external faces of the cam; the external faces of the cam being shaped complementary to the internal faces of the spreader segments whereby an axial force applied to the cam moves the cam axially relative to the mandrel and the spreader segments thereby causing the spreader segments to be moved radially outwardly;

axial force means for applying axial force to the cam, the axial force means including a threaded bolt disposed within the hollow center of the cam, and a cam-engaging member threadedly connected to the bolt, such that rotation of the cam-engaging member with respect to the bolt applies axial force on the cam for mandrel expansion;

spreader segment axial alignment means disposed in contact with the forward, mandrel-insertion ends of the spreader segments for maintaining the spreader segments axially aligned with each other during mandrel expansion while allowing sliding engagement of the internal faces of the spreader segments over the external, curved walls of the cam; and stop means disposed on the outer surface of the cam for limiting the insertion of the cam into the mandrel.

21. A tool kit for reshaping or expanding metal tubular stock comprising:

a pair of expandable mandrels each mandrel including a plurality of spreader segments capable of being held in a cluster about a wedge-shaped cam, the spreader segments having forward, mandrel-insertion ends, external, curved walls and internal faces, the spreader segments of one mandrel being of different outer curvature than the spreader segments of the other mandrel and adapted to be held in a cluster about a single cam;

a wedge-shaped cam axially movable within the mandrels for spreading the spreader segments, the cam including a plurality of external faces corresponding to a number of internal faces on the spreader segments;

means for flexibly retaining the spreader segments of one of the mandrels adjacent to the external faces of the cam in a cluster about the cam while allowing sliding engagement of the segments over the external faces of the cam; the external faces of the cam being shaped complementary to the internal faces of the spreader segments whereby an axial force applied to the cam moves the cam axially relative to the mandrel and the spreader segments thereby causing the spreader segments to be moved radially outwardly;

axial force means for applying axial force to the cam, said axial force means including a threaded bolt disposed within the hollow centers of the cam and the mandrel, and a cam-engaging member connected to the bolt, such that rotation of the cam-engaging member with respect to the bolt applies axial force on the cam for mandrel expansion;

spreader segment axial alignment means disposed in contact with the forward, mandrel-insertion ends of the spreader segments for maintaining the spreader segments aligned axially with each other during mandrel expansion while allowing sliding engagement of the internal faces of the spreader segments over the external faces of the cam; and stop means disposed within the cam engaging member for contact against an end of the bolt for limiting the insertion of the cam into the mandrel.

22. The tool of claim 11, wherein the stop means comprises a tapered inner surface of the cam-engaging member shaped complementary to a tapered end surface of the bolt for contact therebetween.

* * * * *